US006892711B2

(12) United States Patent
Belanger, Jr. et al.

(10) Patent No.: US 6,892,711 B2
(45) Date of Patent: May 17, 2005

(54) INLINE FUEL COOLING OF THE CARBON CANISTER

(75) Inventors: Thomas Dudley Belanger, Jr., Saline, MI (US); Diana D. Brehob, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 45 days.

(21) Appl. No.: 10/065,835

(22) Filed: Nov. 25, 2002

(65) Prior Publication Data

US 2004/0099254 A1 May 27, 2004

(51) Int. Cl.[7] ..... F02M 33/02
(52) U.S. Cl. ..... 123/519; 123/516; 123/541
(58) Field of Search ..... 123/541, 520, 123/521, 519, 518, 516, 41.31

(56) References Cited

U.S. PATENT DOCUMENTS 3,748,829 A * 7/1973 Joyce et al. ..... 95/146
4,572,394 A * 2/1986 Tanahashi et al. ..... 220/86.2
4,701,198 A * 10/1987 Uranishi et al. ..... 96/148
4,741,369 A * 5/1988 Dawson ..... 141/286
4,809,863 A * 3/1989 Woodcock et al. ..... 220/746
5,251,603 A * 10/1993 Watanabe et al. ..... 123/541
5,499,613 A * 3/1996 Bayerle et al. ..... 123/520
5,636,668 A * 6/1997 Thompson ..... 141/82
5,704,337 A * 1/1998 Stratz et al. ..... 123/519
5,861,050 A * 1/1999 Pittel et al. ..... 95/115
5,964,204 A * 10/1999 Freeland ..... 123/516

* cited by examiner

*Primary Examiner*—Carl S. Miller
(74) *Attorney, Agent, or Firm*—Diana D. Brehob

(57) ABSTRACT

A fuel vapor recovery system for a vehicle having a fuel tank coupled to a fuel filler tube. The fuel vapor recovery system includes a carbon canister disposed in the fuel filler tube. Thus, the relatively cool stored fuel passes through the carbon canister disposed in the filler tube before entering the fuel tank. A primary advantage of the present invention is that the problem of the temperature of the carbon rising during vehicle fuelling due to displaced fuel vapors desorbing within the canister is mitigated by heat transfer between the cool fuel passing over the filler tube disposed carbon canister and the entering relatively cool fuel. This heat transfer results in a cooling of the carbon in the canister. Consequently, the carbon in the carbon canister remains effective in desorbing fuel vapors. The filler tube has an inlet for receiving fuel from a supply external to the vehicle. The filler tube is disposed to directing such received fuel to the fuel tank. The carbon canister is disposed within said fuel filler tube to enable the received fuel to contact the canister as such received fuel passes from the inlet, by and in contact with the canister, to the fuel tank.

16 Claims, 2 Drawing Sheets

INLINE FUEL COOLING OF THE CARBON CANISTER

BACKGROUND OF INVENTION

1. Field of the Invention

The present invention relates to carbon canisters, which are used onboard automotive vehicles for collecting hydrocarbon vapors emanating from vehicular fuel systems.

2. Background of the Invention

As is known in the art, modern vehicles are equipped with fuel vapor recovery systems for collecting vapors discharged from a liquid fuel tank onboard the vehicle. Fuel vapors exist in the fuel tank above the liquid fuel. During vehicle refueling, fuel vapors are displaced by liquid fuel entering the fuel tank. The fuel vapor recovery system collects these displaced fuel vapors in a carbon canister mounted, typically, in the engine compartment under the hood.

The fuel vapors absorb onto the surfaces of carbon particles within the carbon canister. When changing from a vapor state to an absorbed state in the canister, the fuel liberates energy causing the temperature in the carbon canister, and hence the temperature of the carbon in such canister to rise. Unfortunately, as the temperature of the carbon in the canister increases, the effectiveness of the carbon-in absorbing the fuel vapors is reduced.

SUMMARY OF INVENTION

The inventors of the present invention have recognized that fuel to be pumped into the vehicle is generally stored below ground and hence is at a relatively cool temperature (i.e., approximately 55° F. or 13° C.). Thus, the inventors have recognized that this relatively cool stored fuel can be used to cool the carbon in the carbon canister.

In accordance with one feature of the invention, a fuel vapor recovery system is provided for a vehicle having a fuel tank coupled to a fuel filler tube. The fuel vapor recovery system includes a carbon canister disposed in the fuel filler tube. Thus, the relatively cool stored fuel passes through the carbon canister disposed in the filler tube before entering the fuel tank. A primary advantage of the present invention is that the problem of the temperature of the carbon rising during vehicle fuelling due to displaced fuel vapors desorbing within the canister is mitigated by heat transfer between the cool fuel passing over the filler tube disposed carbon canister and the entering relatively cool fuel entering the tank. This heat transfer results in a cooling of the carbon in the canister. Consequently, the carbon in the carbon canister remains effective in desorbing fuel vapors.

In one embodiment, the filler tube has an inlet for receiving fuel from a supply external to the vehicle. The filler tube is disposed to direct such received fuel to the fuel tank. The carbon canister is disposed within said fuel filler tube to enable the received fuel to contact the canister as such received fuel passes from the inlet, by, and in contact with the canister, to the fuel tank.

The inventors of the present invention have recognized that the invention is made more effective by improving heat transfer between the carbon canister and the fuel. In one embodiment, the outer surface of the carbon canister has enhanced heat transfer effecting surface area, one example of which is due to fins on the outer surface. In another embodiment, the material of the canister's housing can is made of a material with a thermal conductivity greater than 0.15 W/cm-K. In one embodiment the housing has a thermal conductivity of stainless steel. With such an arrangement, by enhancing the heat transfer the relatively cool stored fuel has an enhanced ability to lower the temperature of the carbon canister.

In accordance with another feature of the invention, the fuel vapor recovery includes: an inlet duct coupled to the carbon canister for conducting ambient air to said carbon canister; a valve in the air inlet duct; and, an outlet duct coupled to the carbon canister for conducting ambient air and fuel vapors to the engine.

In accordance with still another aspect of the invention, the system is arranged to allow access of fuel vapors to the activated charcoal within the canister. In one embodiment, the carbon canister has perforations in an external surface of the carbon canister.

Also disclosed is a method for assembling a fuel vapor recovery system of an automotive vehicle in which the carbon canister is installed within a fuel filler tube coupled to the fuel tank. The method further includes coupling an air inlet duct and an outlet duct to the carbon canister. The ducts transports fresh air to the carbon canister and transports said fresh air mixed with desorbed fuel vapors from the carbon canister to an engine intake, respectively, to purge the carbon canister.

The above advantages, other advantages, and features of the present invention will be readily apparent from the following detailed description of the preferred embodiments when taken in connection with the accompanying drawings.

BRIEF DESCRIPTION OF DRAWINGS

The advantages described herein will be more fully understood by reading an example of an embodiment in which the invention is used to advantage, referred to herein as the Detailed Description, with reference to the drawings wherein.

DETAILED DESCRIPTION

Figure 1:
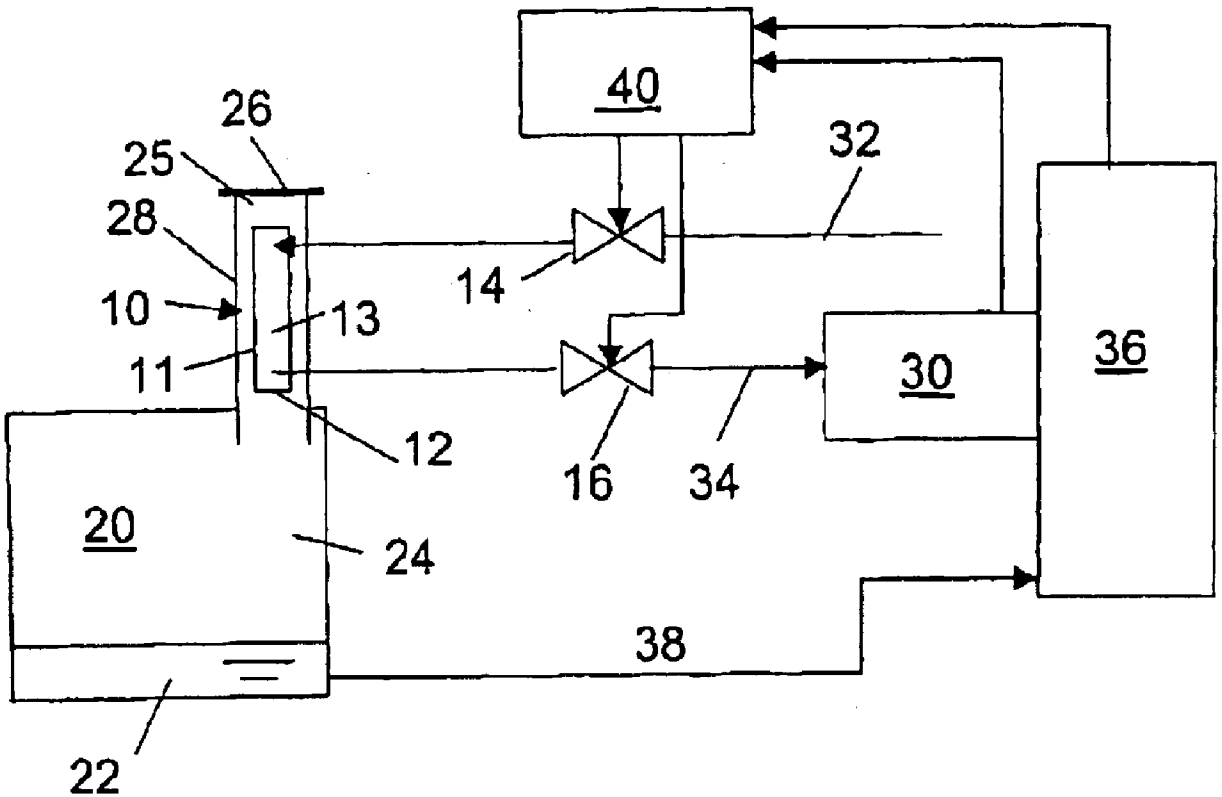
FIG. 1 is a schematic of a vehicular fuel system and a fuel vapor recovery system according to the present invention.

Referring to FIG. 1, a vehicle fuel system is shown as having a fuel tank 20 containing fuel 22 and a volume 24 above fuel 22 containing air and fuel vapors. In order to add fuel to the fuel tank 20, the fuel cap 26 is first removed. Then, fuel is supplied through an inlet 25 at the fuel filler tube 28 from a fuel supply generally stored underground.

More particularly, fuel filler tube 28 has an inlet 25 for receiving fuel from a supply external to the vehicle, not shown. Fuel filler tube 28 is disposed to direct such received fuel-to-fuel tank 20. The carbon canister 10 is disposed within the fuel filler tube 28 to enable the received fuel to contact the carbon canister 10 as such received fuel passes from the inlet 25, by, and in contact with, the canister 10 to the fuel tank 20. A fuel pump (not shown) is typically mounted in fuel tank 20. Fuel is conducted through duct 38 to engine 36.

During fuelling, fuel vapors in volume 24 are displaced by liquid fuel entering the tank 20 through fuel filler tube 28. In the prior art, these vapors are conducted from volume 24 to a carbon canister located within the vehicle, but external to the fuel system, through a duct. According to the present invention, as shown in FIG. 1, carbon canister 10 is disposed within fuel filler tube 28. Carbon canister 10 has a housing 11 with activated charcoal 13 contained inside housing 11. Housing 11 has perforations therethrough, not shown, to allow fuel vapors emanating from volume 24 access to activated charcoal 13.

After collecting fuel vapors for some time, carbon canister 10 becomes saturated, meaning unable to store more fuel vapors. Carbon canister 10 is purged during engine 36 operation. To purge the canister of absorbed vapors, carbon canister 10 is coupled to an engine intake 30 via duct 34 having valve 16. When engine intake 30 is at a reduced pressure due to a throttle valve (not shown) in engine intake 30 being partially closed and valve 16 is open in response from a control signal from electronic control unit 40, a vacuum is placed on carbon canister 10. Ambient air is drawn into carbon canister 10 through duct 32 when valve 14 is open in response to a control signal from electronic control unit 40. Thus, ambient air is drawn into carbon canister 10 via duct 32 and air and fuel vapors are discharged from carbon canister 10 via duct 34, to engine intake 30. It is first noted that the entering ambient air passes through the carbon 13 via the perforations in the housing 11 of the canister 10. It is next noted that the entering air and vapors pass from duct 34 into engine 36 wherein the fuel vapors are combusted. Valves 14 and 16 are connected to the electronic control unit 40, which provides the timing of the purge process, and such timing can be controlled based on signals from sensors, not shown, attached to engine 36 and engine intake 30.

In FIG. 1, ducts 32 and 34 are shown passing through fuel filler tube 28. Alternatively, ducts 32, 34 may pass through a wall of the fuel tank 20 and snake up through fuel filler tube 28 to gain access to carbon canister 10.

Carbon canister 10 absorbs a significant quantity of fuel vapors during a vehicle fuelling operation. During absorption, the temperature of carbon canister 10 rises, thereby reducing its absorption effectiveness. By placing carbon canister 10 in fuel filler-tube 28, heat transfer from carbon canister 10 to the cooler fuel entering the tank 20 via the filler tube 28 occurs when the temperature of carbon canister 10 exceeds that of the entering fuel. Fuel is stored under ground, at a typical temperature of 55° F. or 13° C. Thus, the entering fuel provides cooling during fuelling whenever the carbon canister is above fuel temperature.

Continuing to refer to FIG. 1, the cross-sectional area for conducting fuel through fuel filler tube 28 according to the present invention is roughly equal to the cross-sectional area according to the prior art so that the fuelling operation is not hampered by the presence of carbon canister 10 within fuel filler tube 28. Thus, along carbon canister 10, a cross-sectional area between the exterior surface of carbon canister 10 and an interior surface of fuel filler tube 28 is maintained at that of prior art systems.

As shown in FIG. 1, carbon canister 10 is held in place within fuel filler tube 28 by ducts 32 and 34, which go through the wall of fuel filler tube 28. Alternatively, a bracket between fuel filler tube 28 and carbon canister 10 may be used to secure the carbon canister 10 within the filler tube 28.

Figure 4:
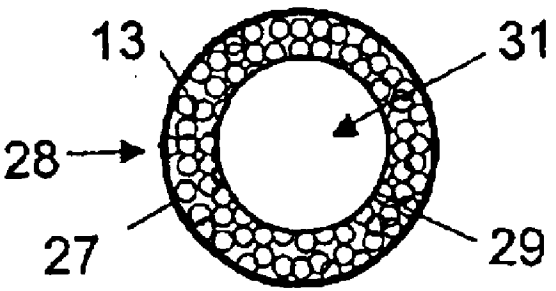
FIG. 4 shows a cross section of the fuel filler tube with the carbon canister as a collar around the fuel passageway.

An alternative embodiment is shown in FIG. 4 in which carbon canister 10 is integrated into fuel filler tube 28. The activated charcoal 13 is contained between an outside surface 27 of fuel filler tube 28 and an inner wall 29 of fuel filler tube 28. Fuel passes through passage 31 which is provided by the inside of inner wall 29.

Figure 5:
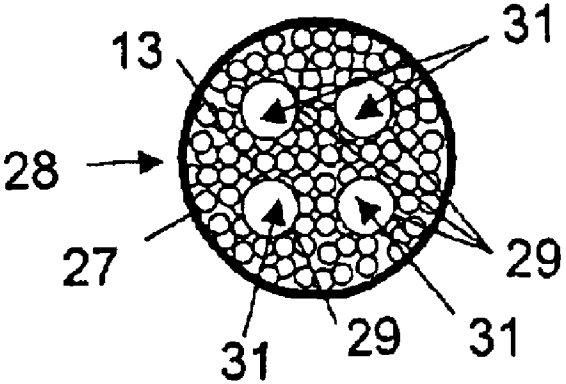
FIG. 5 did not get this figure shown a cross section of the fuel filler tube with multiple fuel passageways going through the carbon canister.

Another embodiment in which multiple fuel passageways, are provided through carbon canister 10 using walls of element 29 is shown in FIG. 5. An advantage of having multiple passageways is the increased surface area contact between the fuel and the passageways. Here, there are multiple passages 31 from the received fuel.

The heat transfer rate between the activated charcoal within the housing of carbon canister 10 and the received fuel determines the effectiveness of the invention. The inventors of the present invention have recognized two factors affecting the heat transfer rate: heat transfer between the fuel and the housing and heat transfer between the housing and the activated charcoal within the housing.

Figure 2:
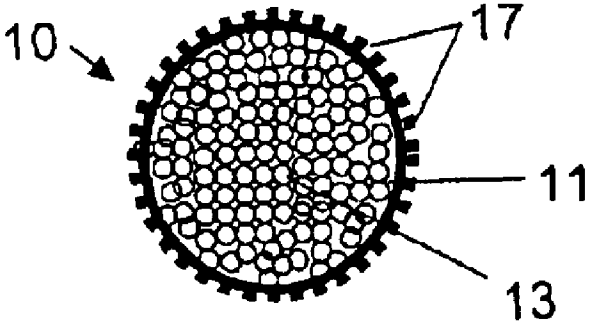
FIG. 2 shows a cross-section of a carbon canister according to the present invention.

To improve heat transfer between the fuel and the housing, one embodiment, shown in FIG. 2, has a plurality of cooling fins 17 disposed on the outside of the surface of carbon canister 10. These fins can be protrusions extending radially outward from the outside surface of the housing. Alternatively, the surface may be dimpled or corrugated to increase the surface area of the housing in contact with the entering fuel during fuelling.

Another measure to increase heat transfer rate between housing 13 and the entering fuel is to select a material for the housing 13 with a high thermal conductivity. A material such as copper is preferred for heat transfer purposes. The material should have a thermal conductivity at least better than stainless steel (0.15 W/cm-K).

Figure 3:
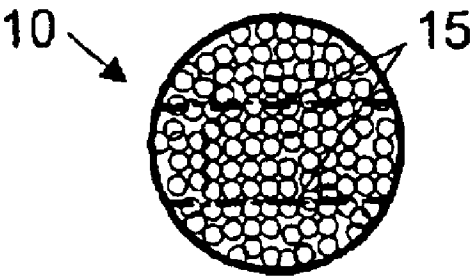
FIG. 3 shows conductive strips attached to the interior of a carbon canister according to the present invention.

Referring now to FIG. 3, a perforated plate is shown extending between internal surfaces of the housing of carbon canister 10. This plate acts as an internal fin transferring away energy from the activated charcoal in the interior of the housing, thereby improving heat transfer rate between the housing and the activated charcoal. The plates shown in FIG. 3 are merely examples. Any conductive strips connected to the interior surface of the housing are alternatives. The conductive strips preferably do not interfere with loading the activated carbon during assembly.

The inventors of the present invention have recognized that a carbon canister, which is conventionally mounted in a vehicle, that is, in which the outside of the canister is in communication with air during fuelling, can also benefit by putting conductive strips or perforated plates in the interior of the canister. By placing these conductive fins through the canister, the heat transfer from the housing to the activated carbon is enhanced.

While several modes for carrying out the invention have been described in detail, those familiar with the art to which this invention relates will recognize conventional designs and embodiments for practicing the invention. The above-described embodiments are intended to be illustrative of the invention, which may be modified within the scope of the following claims.

We claim:

1. A fuel vapor recovery system for an internal combustion engine disposed in a vehicle, the vehicle having a fuel tank coupled to a fuel filler tube, comprising:

a carbon canister having a housing and activated charcoal within said housing, said carbon canister being in communication with the fuel tank such that fuel vapors in the fuel tank have access to said activated charcoal wherein said carbon canister is mounted in the fuel filler tube; and at least one conductive plate connected to an inside surface of said housing, said conductive plate being in contact with said activated charcoal.

2. The fuel vapor recovery system of claim 1, further comprising:

an inlet duct coupled to said carbon canister for conducting ambient air to said carbon canister;

a valve in said air inlet duct; and an outlet duct coupled to said carbon canister for conducting ambient air and fuel vapors to the engine.

3. A fuel system for an internal combustion engine disposed in a vehicle, comprising:

a fuel filler tube;

a fuel tank coupled to an exit of said fuel filler tube;

a fuel cap coupled to an opening of said fuel filler tube; and a carbon canister disposed within said fuel filler tube wherein said carbon canister is in communication with said fuel filler tube.

4. The fuel vapor recovery system of claim 3 wherein an outer surface of said carbon canister has enhanced thermal transfer surface area to increase contact area between said carbon canister and said fuel.

5. The fuel vapor recovery system of claim 3 wherein an outer surface of said carbon canister has fins.

6. A fuel vapor recovery system for an internal combustion engine disposed in a vehicle, the vehicle having a fuel tank coupled to a fuel filler tube, the fuel vapor recovery system comprising: a carbon canister disposed in the fuel filler tube wherein said carbon canister is further comprised of a housing, activated charcoal within said housing, and conductive strips attached to an interior surface of said housing, said conductive strips being in contact with said activated charcoal.

7. The fuel vapor recovery system of claim 6 wherein said carbon canister is further comprised of a housing comprising a material having a thermal conductivity greater than 0.15 W/cm-K and activated charcoal disposed inside said housing.

8. The fuel vapor recovery system of claim 6 wherein a cross-sectional area ratio between an outer surface of said carbon canister and an inner surface of the fuel filler tube is greater than a predetermined ratio.

9. The fuel vapor recovery system of claim 3 wherein said carbon canister has at least one perforation for allowing fuel vapors to pass through an external surface of said carbon canister.

10. The method of claim 3 wherein the carbon canister absorbe fuel vapor from said vehicle fuel tank.

11. The fuel system of claim 3 wherein said carbon canister is further comprised of a housing, activated charcoal within said housing, and conductive strips attached to an interior surface of said housing, said conductive strips being in contact with said activated charcoal.

12. The fuel system of claim 3 wherein said fuel cap is decoupled from said opening of said fuel filler tube during fuel delivery.

13. The fuel vapor recovery system of claim 3 wherein said carbon canister is further comprised of a housing comprising a material having a thermal conductivity greater than 0.15 W/cm-K and activated charcoal disposed inside said housing.

14. The fuel vapor recovery system of claim 3 wherein a cross-sectional area ratio between an outer surface of said carbon canister and an inner surface of the fuel filler tube is greater than a predetermined ratio.

15. A method for assembling a fuel vapor recovery system of an automotive vehicle, the fuel vapor recovery system having a carbon canister for absorbing fuel vapors, comprising;

installing the carbon canister within a fuel filler tube wherein said fuel filler tube is coupled to a vehicle fuel tank comprising: coupling an air inlet duct and an outlet duct to the carbon canister wherein said ducts pass through said fuel filler tube.

16. The method of claim 15 wherein said air inlet duct transports fresh air to the carbon canister and said outlet duct transports said fresh air mixed with desorbed fuel vapors from the carbon canister to an engine intake, said engine being disposed in the vehicle.

* * * * *